US005390094A

United States Patent [19]

Evanisko

[11] Patent Number: 5,390,094

[45] Date of Patent: Feb. 14, 1995

[54] ALL-WEATHER COLD-CATHODE LIGHTING ASSEMBLY

[75] Inventor: Jim Evanisko, Hasbrouck Heights, N.J.

[73] Assignee: National Cathode Corp., New York, N.Y.

[21] Appl. No.: 227,454

[22] Filed: Apr. 14, 1994

[51] Int. Cl.[6] ..... F21V 29/00; F21S 3/00

[52] U.S. Cl. ..... 362/267; 362/311; 362/225; 362/218; 362/224; 362/216; 362/219

[58] Field of Search ..... 362/332, 311, 248, 225, 362/218, 294, 267, 335, 224, 264, 216, 217, 223, 219, 262, 310, 222

[56] References Cited

U.S. PATENT DOCUMENTS

| | | | |
|---|---|---|---|
| 2,291,488 | 7/1942 | Naysmith | 362/222 |
| 3,634,681 | 1/1972 | Johnson et al. | 362/216 |
| 4,246,629 | 1/1981 | Marrero | 362/225 |
| 5,255,166 | 10/1993 | Gonzalez | 362/216 |

FOREIGN PATENT DOCUMENTS

| | | | |
|---|---|---|---|
| 1091494 | 10/1954 | France | 362/217 |
| 1243347 | 8/1960 | France | 362/217 |
| 6605246 | 10/1967 | Netherlands | 362/218 |
| 477650 | 10/1969 | Switzerland | 362/217 |

*Primary Examiner*—Ira S. Lazarus
*Assistant Examiner*—Sara Sachie Raab
*Attorney, Agent, or Firm*—Schweitzer Cornman & Gross

[57] ABSTRACT

An all-weather cold-cathode lighting assembly comprising a series of elongated cold cathode lamp sections electrically interconnected and arrayed in a predetermined geometric configuration having a first end, at least one intermediate bend, and a second end; a series of spaced lampholders including single-socketed end-most feed lampholders supporting the first and second ends of the array and intermediate double-socketed lampholders supporting and electrically connecting adjacent intermediate end portions of the intermediate lamp sections; a weather-proof lens assembly comprising a plurality of elongated transparent or translucent thermoplastic housing sections having walls of generally inverted U-shaped cross section, said housing sections being arrayed congruently with and substantially enclosing said series of lamp sections; said lens housing sections being butted and adhesively joined with clear cement to establish an effectively unitary lens having said predetermined geometric configuration.

6 Claims, 2 Drawing Sheets

ALL-WEATHER COLD-CATHODE LIGHTING ASSEMBLY

BACKGROUND OF THE INVENTION

Cold-cathode lighting has been used as an architectural lighting tool with unusual flexibility. Lamps are generally elongated glass tubes filled with a luminescent gas which when energized emits a light of a color depending upon the phosphorescent coating of the tube. Series of tubes are typically arrayed in various geometries to conform with architectural arches to provide unusual lighting and decorative effects owing to the long continuous lines of light. Heretofore, cold-cathode lighting has been available primarily for indoor usage, for example, in coffers, on ceilings, along columns and beams, and on walls.

Architectural cold-cathode lighting systems employ a series of lamps deployed end-to-end and interconnected in series to provide a continuous line of light in the geometric pattern in which the tubes have been arrayed. The individual lamps are supported on opposite ends in sockets of appropriate ceramic lampholders having electrodes through which the energizing circuit for the lamps is established. The entire array is itself powered through a remote transformer.

It is to improvements in cold-cathode lighting systems, specifically adapting them for all-weather usage, to which the present invention is directed.

SUMMARY OF THE PRESENT INVENTION

In accordance with the principles of the present invention, a cold-cathode lighting array of any geometric configuration may be employed for all-weather usage, outdoors, by associating and combining a special all-weather lens assembly with the cold-cathode lamps and lampholders in a manner to fully protect the cold-cathode lamp array from the deleterious effects of outdoor elements. More particularly, the lens is formed from a series of elongated transparent or translucent thermoplastic lens housing sections of inverted U-shaped cross section which are interconnected in the array of the cold-cathode lamps to provide an effectively unitary lens covering and protecting the entire cold-cathode lamp array. The individual housing sections are mitered and butted with clear adhesive cement interconnections to form a continuous lens in the same shape as the cold-cathode lamp array. Each lens housing section includes integral projecting flanges through which the entire lens housing assembly may be permanently connected to an outdoor structure such as a roof or outside wall. In addition, the ends of the lens housing assembly, when they are not interconnected to form a continuous closed loop lens housing assembly, are closed off by clear plastic end panels. Ventilation of the enclosed cold-cathode lamps and lampholders is provided by canted vent holes which are disposed in the side walls of the individual lens housing sections.

For more complete understanding of the present invention and other of its attendant advantages, reference should be made to the following detailed description of the invention, taken in conjunction with the accompanying drawings.

DETAILED DESCRIPTION OF THE INVENTION

Figure 1:
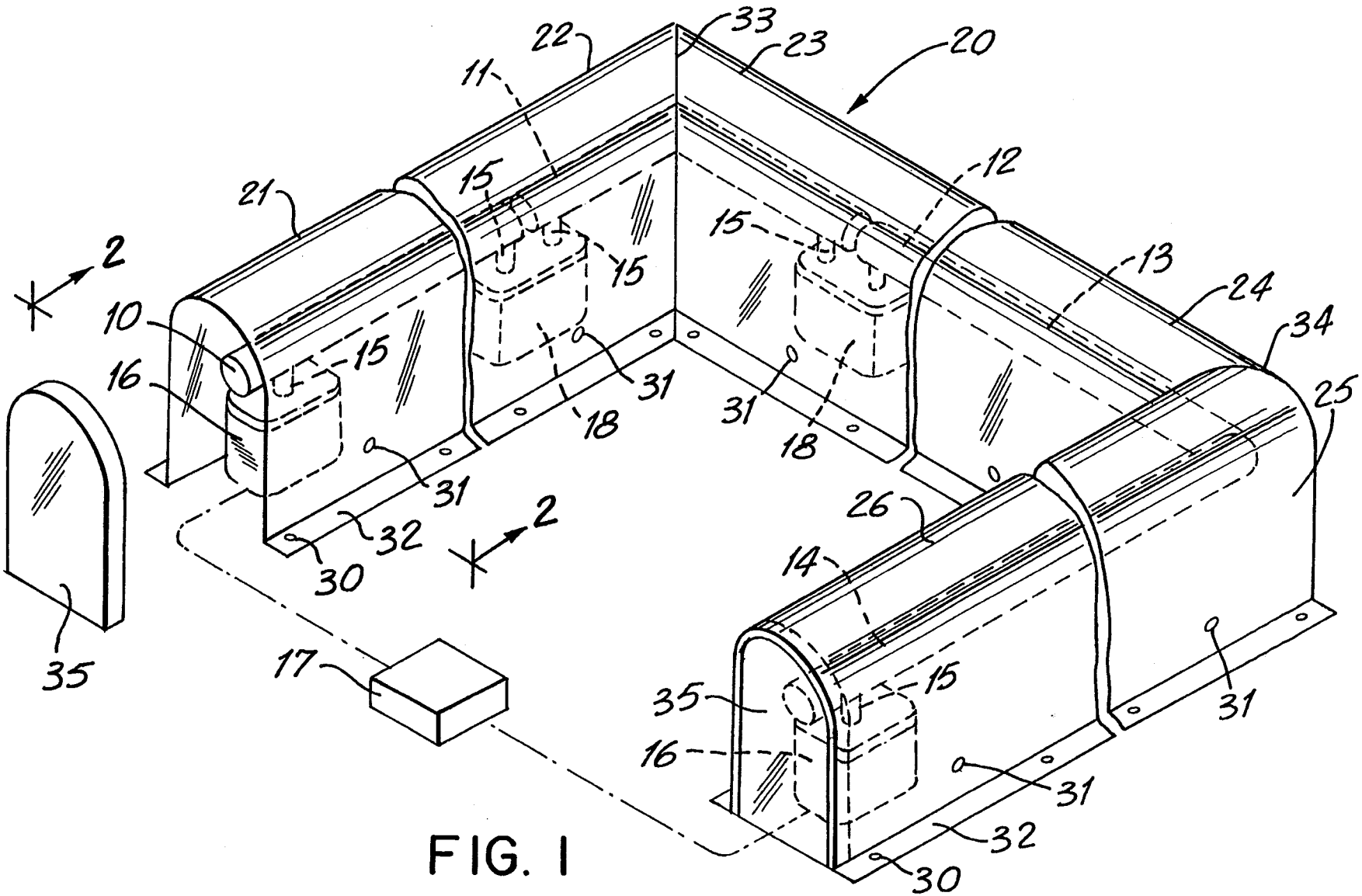
FIG. 1 is a perspective view of the all-weather cold-cathode assembly of the present invention.

Referring now to FIG. 1, the all-weather cathode lighting assembly of the present invention includes a series of one inch diameter cold-cathode lamps 10, 11, 12, 13, 14 arrayed in a U-shaped configuration which in practice is of substantial size and would include many sections of elongated cold-cathode lamps, each of which is typically approximately eight feet long. As will be understood, glass cold-cathode lamps may be bent under elevated temperatures into various shapes: curved; fight-angled; and the like. Thus, in the illustrated array, corner cold-cathode tubes 11 and 13 have right-angle bends in order for the entire assembly to achieve the exemplary U-shaped configuration. As is conventional, each of the cold-cathode lamps 11–14 has depending right-angled legs 15 which include electrodes 9 at their bottommost portions through which the gas retained within the lamps may be energized so as to become luminescent and provide white or colored light to the ambient atmosphere. The endmost lamps 10 and 14 in the array have their outer end portions supported in conductive sockets 8 of lampholders 16 which in turn are connected to a transformer 17 through which the entire lighting array will be provided with the requisite voltage and amperage to cause the entire series of lamps to be lighted. The intermediate lamps 11, 12, and 13 are supported in intermediate two-socket lampholders 18 of conventional configuration which, as shown, accept the adjacent right-angled legs 15 of contiguous lamps in the predetermined array.

While the geometric configuration of the cold-cathode lighting assembly illustrated in FIG. 1 is shown as being a generally U-shaped array, it will be understood that any planar geometric configuration will lend itself to lighting by cold-cathode lamps arrayed to conform to the desired geometric shape. The shape may be established by a combination of straight cold-cathode tubes and bent cold-cathode tubes as will be understood.

Figure 2:
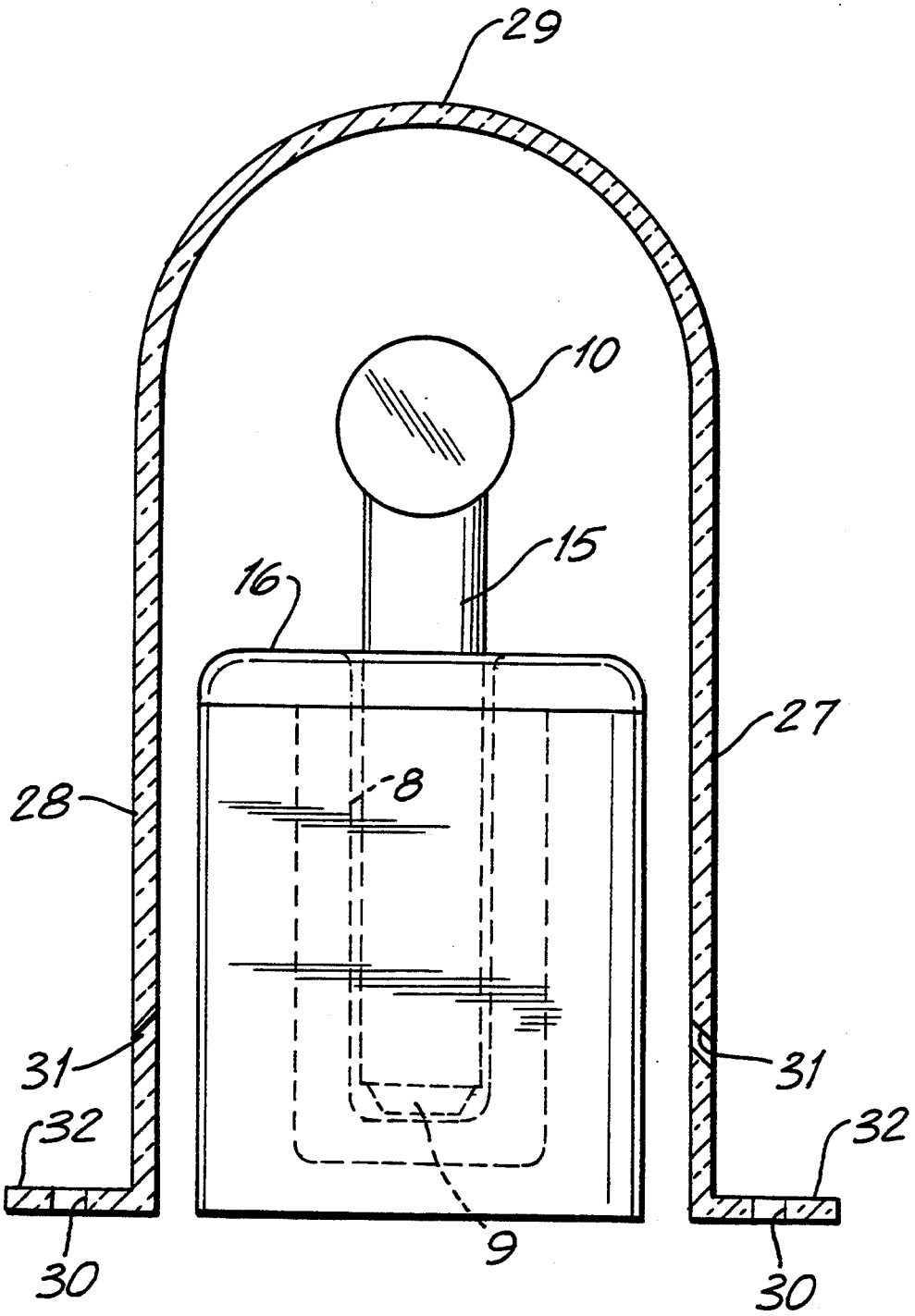
FIG. 2 is a cross-sectional view taken along line 2—2 of FIG. 1.

In accordance with the principles of the invention, the geometric array of cold-cathode lighting lamps is fully enclosed and completely protected by a lens assembly 20 formed from a series of elongated lens housing sections 21, 22, 23, 24, 25, and 26 (it being understood that as many sections as needed will be employed) to establish an effectively unitary structure which is generally congruent with and adapted to envelop the cold-cathode lighting array. Each of the lens housing elements, which are all similar in cross section and advantageously may be extruded with a single die, includes a pair of upstanding walls 27, 28 interconnected by a domed or otherwise semicircular upper portion 29 as shown in FIG. 2. The lowermost portions of the walls 27, 28 have outwardly projecting flanges 32 having mounting holes 30 formed therein.

The individual lens housing sections are advantageously fabricated from clear or translucent high-impact acrylic available from Rohm and Haas, No. DR1 UL E39437-H, which plastic is also ultra-violet stabilized. Typical sections of the new lens housing are approximately eight feet long having a wall thickness of one eighth of an inch and the height from the flange 32 to the top of the dome portion 29 being approximately six inches. The curved dome is of 1.5 inch radius while the walls 27, 28 are spaced 3 inches apart. As shown in FIG. 2, this geometry provides adequate clearance for the typical lampholder 16 and the cold-cathode lamp tube and leg supported therein. Each lens housing section is also provided with a canted vent hole 31 located towards the bottom of the opposite walls 27, 28. The vent hole is typically one eighth inch in diameter.

As shown in FIG. 1, the sections 21 through 26 of lens housing are arrayed end-to-end to conform with the shape of the cold-cathode array. Adjacent elongated sections of lens housing are butted and interconnected by a clear silicone cement to join the sections into a unitary transparent or translucent lens assembly. Where bends are required, such as in the right-angled corners of the illustrated U-shaped array, appropriate angled miter cuts are made in the ends of consecutive housing sections 22, 23, 24, and 25 so that the sections may be butted together and adhesively joined along a mitered plane of interconnection 33 and 34 as shown in FIG. 1.

If the array of cold-cathode lamps is a closed geometric configuration, for example a square or a rectangle, the individual lens housing sections would be arrayed to form a closed four-sided shape in which there would be an additional two mitered planes corresponding to the planes 33, 34, as will be understood. However, in the illustrated open U-shaped array, lens housing assembly 20 is closed off by a pair of clear plastic end panels 35 which are tightly fitted and cemented within the endmost portions of the housing sections 21 and 26.

The entire all-weather lens assembly may be fastened by bolts or other threaded fasteners to an outdoor roof or an exposed wall through the flanges 32 and the mounting holes 30 formed therein, as will be understood. The lampholders 16 and 18 will, of course, be similarly fastened to the same mounting surface to which the lens housing assembly 20 is secured.

Although the foregoing description of the new all-weather cold-cathode lighting assembly has been given by way of an example of a preferred embodiment, it will be understood by those skilled in the art that other forms of the invention falling within the ambit of the following claims are contemplated. Accordingly, reference should be made to the following claims in determining the full scope of the invention.

What is claimed is:

1. An all-weather cold-cathode lighting assembly comprising (a) a series of elongated cold cathode lamp sections electrically interconnected and arrayed in a predetermined geometric configuration having a first end, at least one intermediate bend, and a second end;

(b) a series of spaced lampholders including single-socketed endmost feed lampholders supporting the first and second ends of the array and intermediate double-socketed lampholders supporting and electrically connecting adjacent intermediate end portions of the intermediate lamp sections;

(c) a weather-proof lens assembly comprising a plurality of elongated light transmissive thermoplastic housing sections having walls of generally inverted U-shaped cross section, said housing sections being arrayed congruently with and substantially enclosing said series of lamp sections;

(d) said lens housing sections being butted and adhesively joined with clear cement to establish an effectively unitary lens having said predetermined geometric configuration.

2. The lighting assembly of claim 1, in which (a) lens end panels of light transmissive thermoplastic close off the ends of said lens assembly.

3. The lighting assembly of claim 1, in which (a) said housing sections include integral mounting flanges extending outwardly from a lowermost portions of said walls.

4. The lighting assembly of claim 1, in which (a) said housing sections include a plurality of canted vent holes.

5. The lighting assembly of claim 1, in which (a) said U-shaped cross section includes parallel side walls bridged by a semi-circular dome portion.

6. The lighting assembly of claim 5, in which (a) said walls are approximately one eighth inch thick and are spaced apart approximately 3 inches; and (b) said lens sections are approximately 6 inches in height.

* * * * *